US006016675A

United States Patent [19]

Te

[11] Patent Number: 6,016,675

[45] Date of Patent: Jan. 25, 2000

[54] RETAINING DEVICE PROVIDED WITH LOCK

[76] Inventor: Yu Chun Te, No. 255, Sec. 3, Yen-Hi Rd., Fu shing, Chang-Hwa, Taiwan

[21] Appl. No.: 09/188,292

[22] Filed: Nov. 9, 1998

[51] Int. Cl.[7] ..... E05B 37/02

[52] U.S. Cl. ..... 70/312; 70/68; 70/70

[58] Field of Search ..... 24/310, 312, 323; 70/312, 30, 49, 18, 68, 69, 70

[56] References Cited

U.S. PATENT DOCUMENTS

| | | | |
|---|---|---|---|
| 3,060,537 | 10/1962 | Hatfield | 24/312 |
| 4,685,315 | 8/1987 | Comolli | 70/68 |
| 4,912,950 | 4/1990 | Crowle | 70/58 |
| 5,117,663 | 6/1992 | Ida | 70/70 |
| 5,517,836 | 5/1996 | Hong | 70/312 |
| 5,669,253 | 9/1997 | Higgins | 70/312 |
| 5,692,403 | 12/1997 | Ling | 70/57 |

*Primary Examiner*—Darnell M. Boucher
*Attorney, Agent, or Firm*—Harrison & Egbert

[57] ABSTRACT

A retaining device is composed of a male retainer, a female retainer, and a lock. The male retainer is provided with a retaining tongue. The female retainer is provided with a base and a retaining piece. The lock is fastened with the rear section of the retaining piece. Located at the junction of the retaining piece and the lock is a shaft by which the lock and the retaining piece are fastened pivotally with the base in conjunction with a spring. The retaining piece and the lock act simultaneously. The lock serves to lock or unlock the retaining device. The lock also serves to buckle or unbuckle the male retainer and the female retainer of the retaining device.

1 Claim, 11 Drawing Sheets

RETAINING DEVICE PROVIDED WITH LOCK

FIELD OF THE INVENTION

The present invention relates generally to a retaining device, and more particularly to a retaining device provided with a lock.

BACKGROUND OF THE INVENTION

The conventional retaining device is generally not provided with a lock. The case in point is a buckle as shown in FIG. 1 in which the buckle is pointed at by an arrow "A".

SUMMARY OF THE INVENTION

The primary objective of the present invention is therefore to provide a retaining device with a lock.

In keeping with the principle of the present invention, the foregoing objective of the present invention is attained by the retaining device consisting of a male retainer and a female retainer. The male retainer is provided with a retaining tongue, whereas the female retainer is composed of a base, a retaining piece, and a lock fastened with the rear section of the retaining piece. Located between the retaining piece and the lock is a shaft by which the retaining piece and the lock are fastened pivotally with the base in conjunction with a spring. The retaining piece and the lock are capable of operating simultaneously. The lock is capable of locking and unlocking the retaining device. In addition, the lock serves to buckle and unbuckle the male retainer and the female retainer.

The foregoing objective, features, functions, and advantages of the present invention will be more readily understood upon a thoughtful deliberation of the following detailed description of the present invention with reference to the accompanying drawings.

BRIEF DESCRIPTION OF THE DRAWINGS

FIG. 6 shows a schematic view of the present invention at

DETAILED DESCRIPTION OF THE INVENTION

Figure 1:
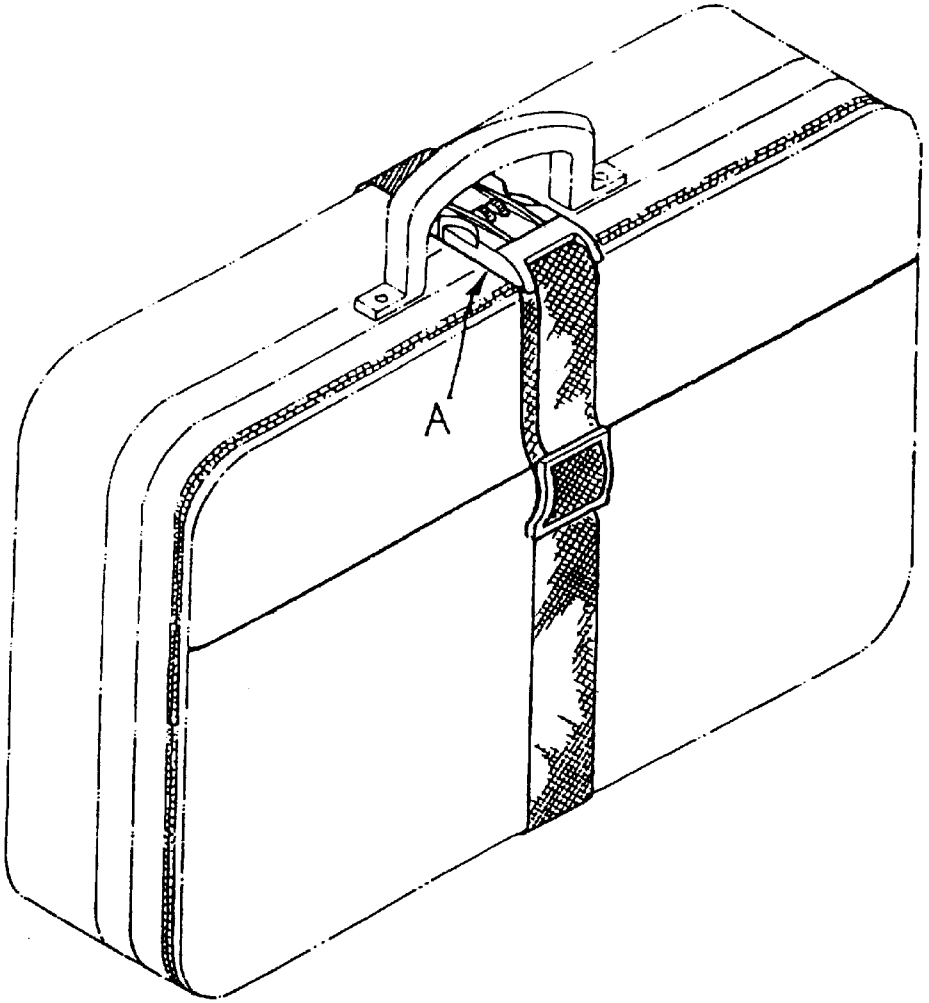
FIG. 1 shows a schematic view of a retaining device of the prior art.
Figure 2:
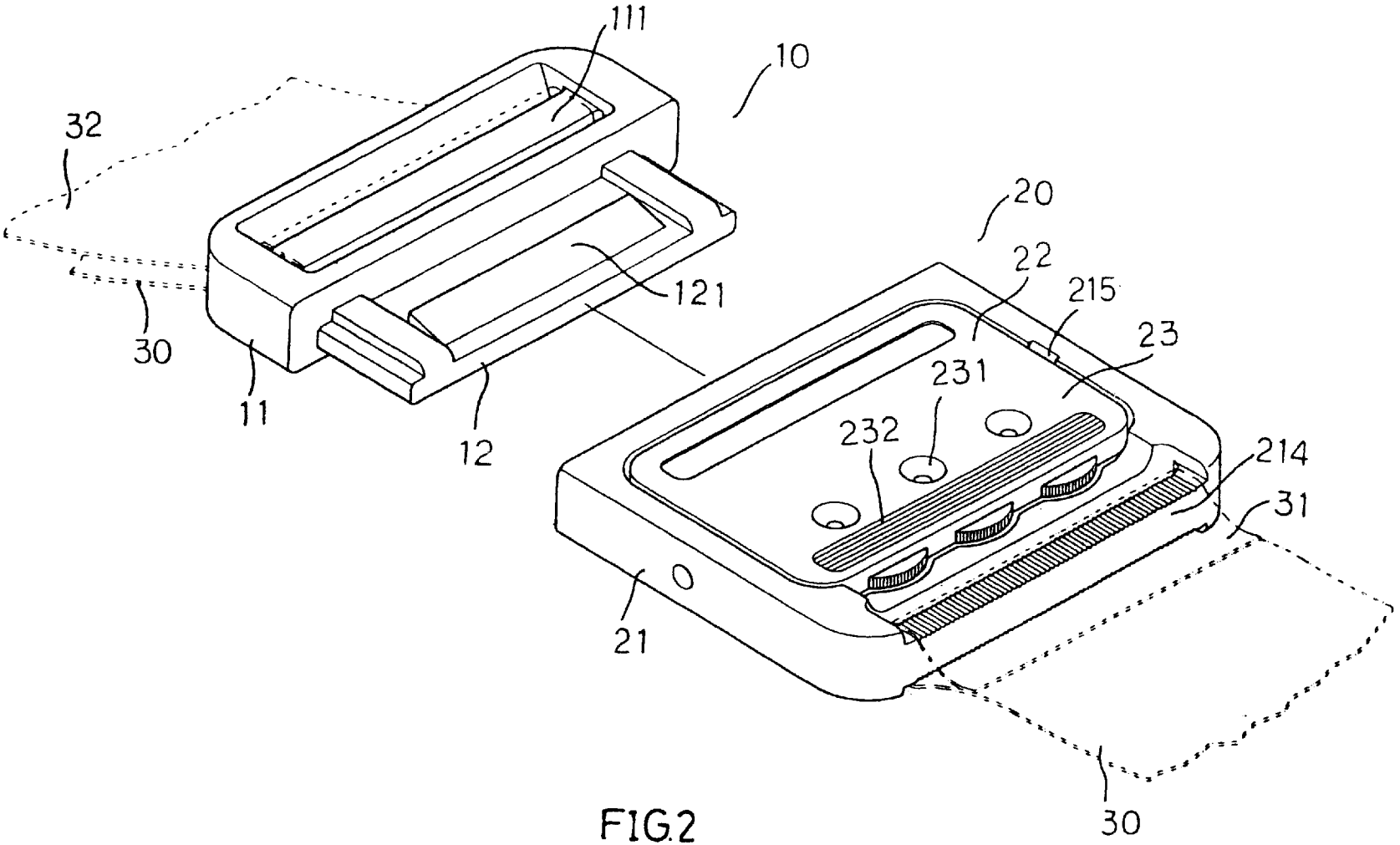
FIG. 2 shows a perspective view of the present invention.
Figure 3:
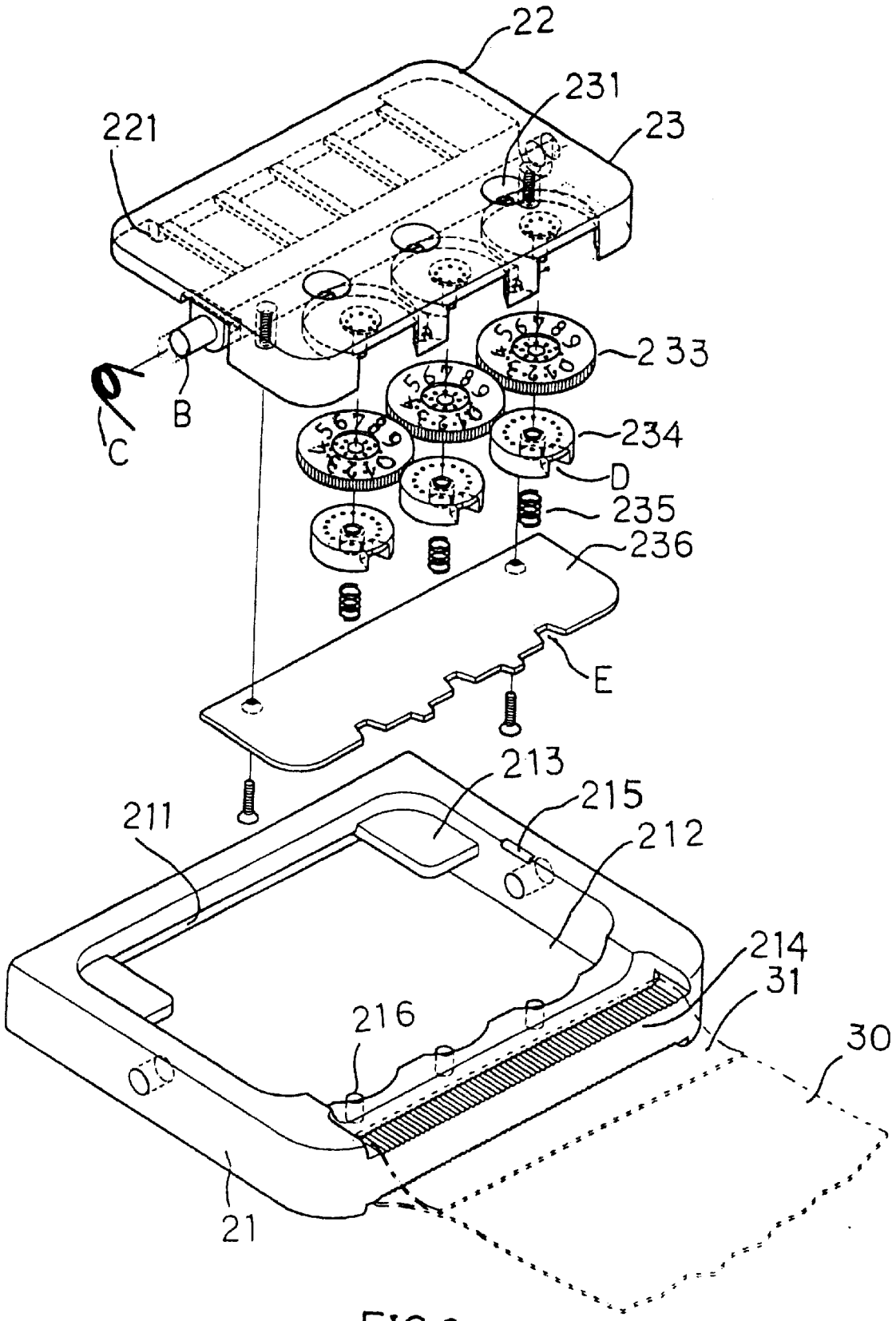
FIG. 3 shows an exploded view of the female retainer of the present invention.
Figure 4:
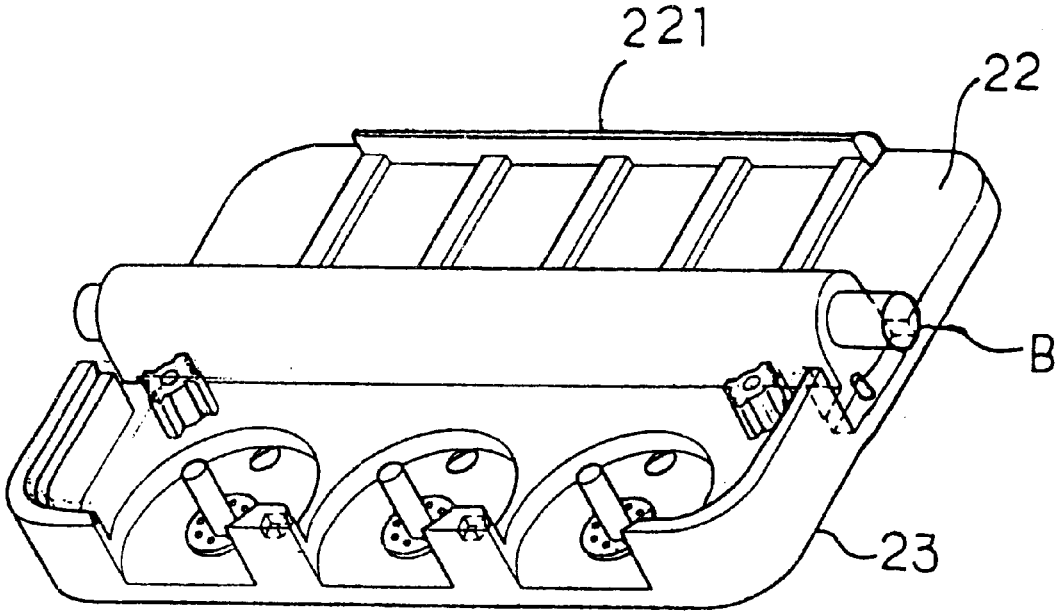
FIG. 4 shows a perspective view of the retaining piece of the present invention.

As shown in FIGS. 2–4, a retaining device embodied in the present invention is composed of a male retainer 10, a female retainer 20, and a lock 23. The male retainer 10 and the female retainer 20 are fastened respectively with both ends of a strap 30.

The male retainer 10 is provided with a tongue 12 and a frame 11 having an adjustment rod 111.

Figure 5:
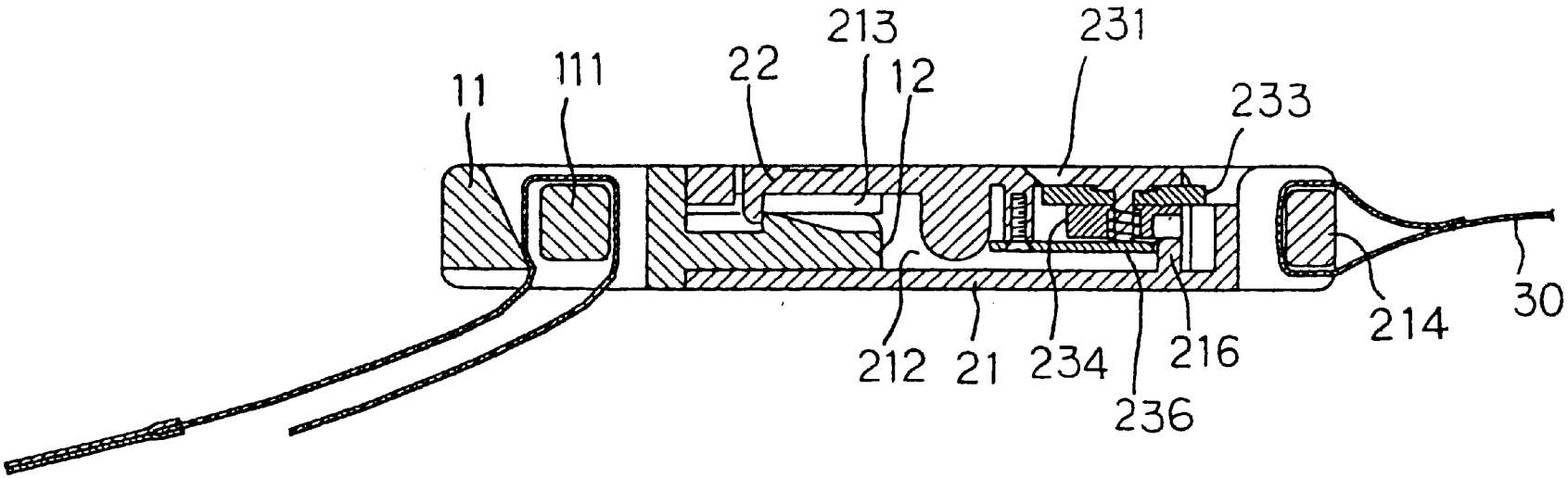
FIG. 5 shows a sectional view of the present invention.

The female retainer 20 is composed of a base 21, a retaining piece 22, and a lock body 23 fastened with the rear end of the retaining piece 22. The base 21 is provided with an insertion port 211 corresponding in location to and engageable with the tongue 12 of the male retainer 10. The base 21 is further provided with a receiving space 212, an arresting piece 213, and a cord fastening rod 214. The insertion port 211 is provided with a retaining edge 221. Located at the junction of the retaining piece 22 and the lock 23 is a shaft "B". The retaining piece 22 and the lock 23 are disposed in the receiving space 212 of the base 21 such that the base 21 and the lock 23 are inserted into the receiving space 212 from a side guide edge 215 of the base 21, and that the retaining piece 22 and the lock 23 are pivoted by the shaft "B" in conjunction with a spring "C". The retaining piece 22 and the lock 23 are capable of acting simultaneously. The arresting piece 213 is intended to confine the retaining piece 22 at the initial position such that the retaining edge 221 of the retaining piece 22 is located between the two arresting pieces 213 and is slightly jutted out of the insertion port 211, as shown in FIG. 5. The lock 23 is a combination lock and is provided with a window 231 and a press area 232. The lock 23 is composed of three sets of numbered wheels 233, an inner sleeve 234 having an indentation "D", and a spring 235. A bottom plate 236 is provided with an indentation "E" corresponding in location to the indentation "D". The base 21 is provided with an urging pillar 216 corresponding in location to the indentation "E".

Figure 7:
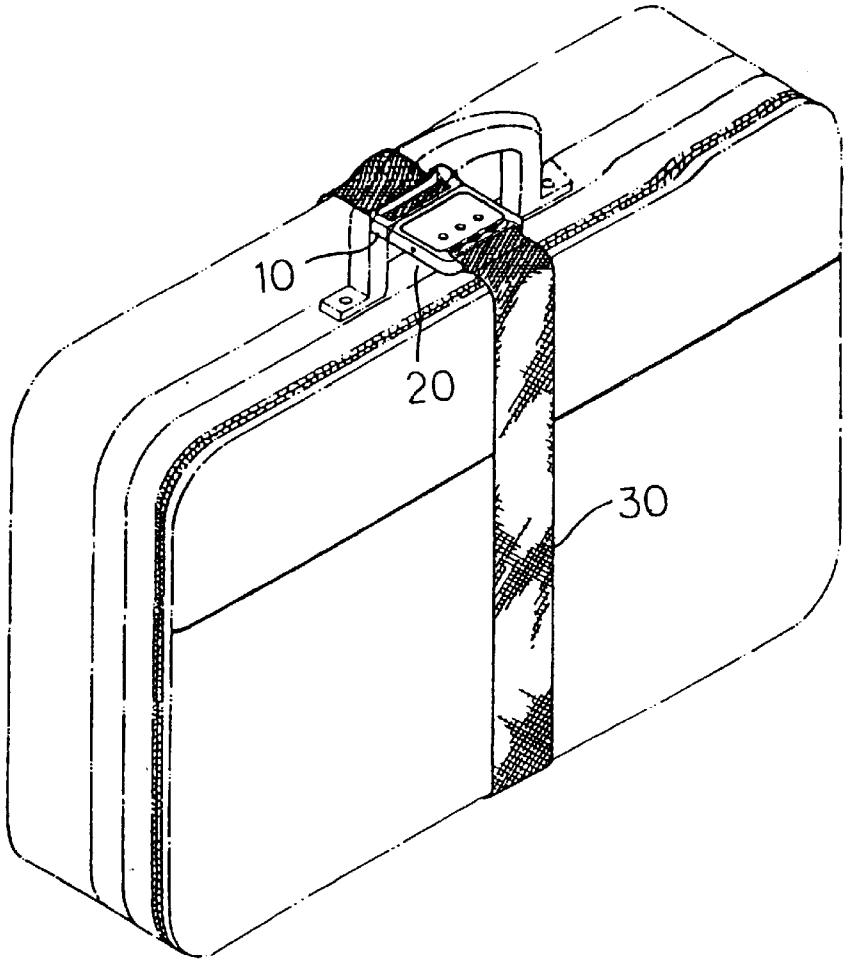
FIG. 7 shows a schematic view of the present invention in conjunction with a bag.

The strap 30 has a fixed end 31 which is fastened with the cord fastening rod 214 of the female retainer 20. The strap 30 further has an adjustment end 32 which is run through the adjustment rod 111 of the male retainer 10. The adjustment end 32 is used to adjust the tightness of the strap 30 after the male retainer 10 and the female retainer 20 are engaged with each other, as shown in FIG. 7.

Figure 6:
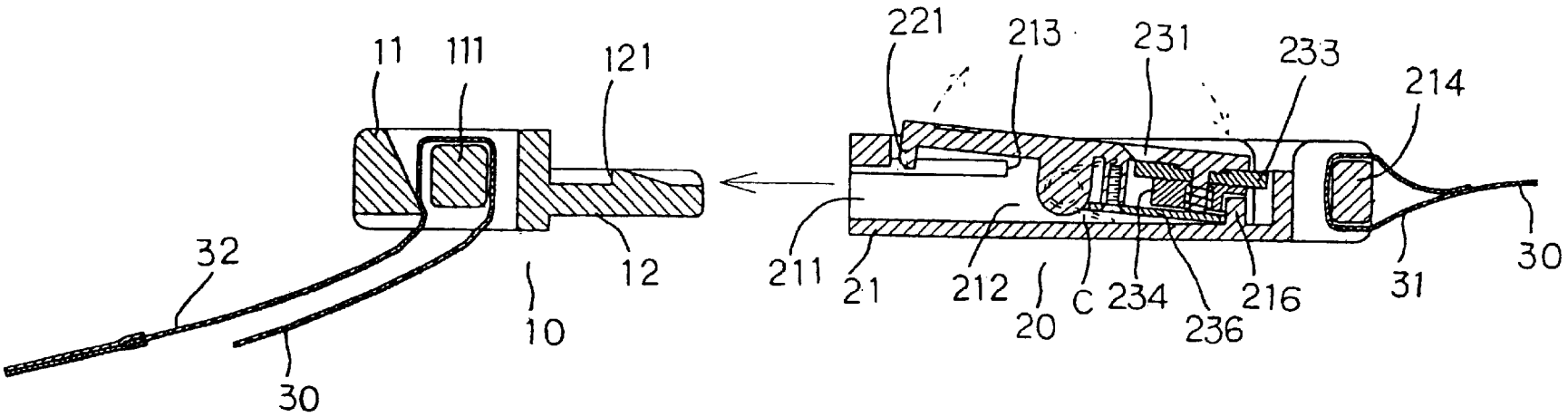

As shown in FIG. 5, the male retainer 10 is engaged with the female retainer 20 such that the retaining edge 121 of the retaining tongue 12 of the male retainer 10 is engaged with the retaining edge 221 of the retaining piece 21 of the female retainer 20. However, the lock 23 remains in the unlocking state such that the indentations "D" of the inner sleeve 234 are aligned with the indentations "E" of the bottom plate 236. As a result, an angular displacement of the lock 23 is brought about after the press area 232 of the lock 23 is pressed. The urging pillars 216 are therefore inserted into the indentations "D" of the inner sleeve 234 and the indentations "E" of the bottom plate 236. In the meantime, an angular displacement of the retaining piece 22 located at other side of the lock 23 is brought about, as shown in FIG. 6. The retaining edge 221 of the retaining piece 22 is no longer engaged with the retaining tongue 12 of the male retainer 10. The male retainer 10 can be thus disengaged with the female retainer 20.

As shown in FIG. 5, the numbered wheels 233 are randomly dialed such that one of the indentations "D" of the inner sleeve 234 is no longer aligned with the indentation "E" of the bottom plate 236. In the meantime, the bottom of the inner sleeve 234 is urged by the urging pillar 216 such that the lock 23 remains stationary even if the lock 23 is exerted on by an external force. The lock 23 is therefore in the locking state such that the male retainer 10 can not be disengaged with the female retainer 20.

Figure 8:
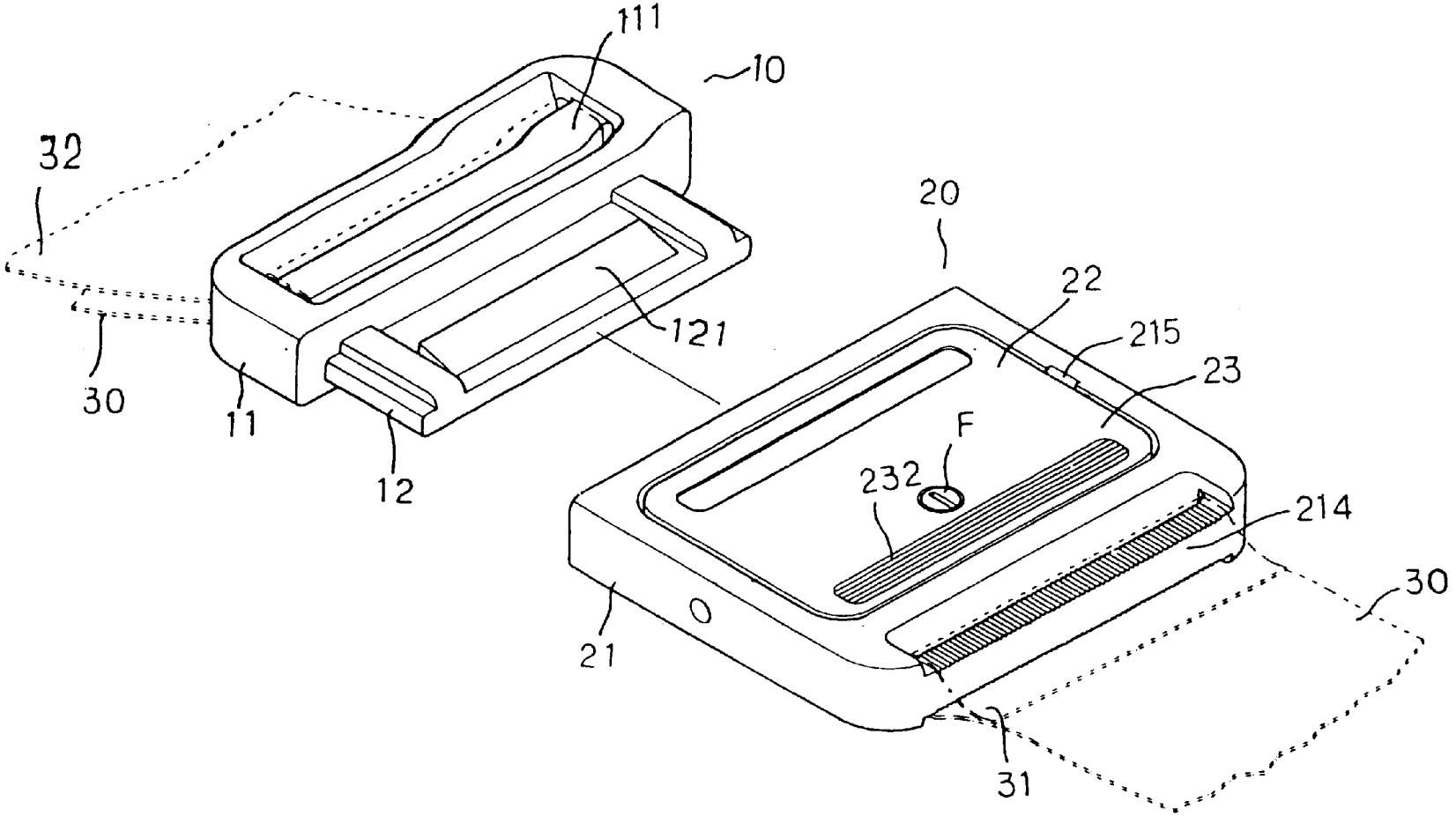
FIG. 8 shows a perspective view of the lock of the retaining device of the present invention.

As shown in FIG. 8, the present invention is provided with a lock core "F" and is therefore operated in conjunction with a key.

Figure 9:
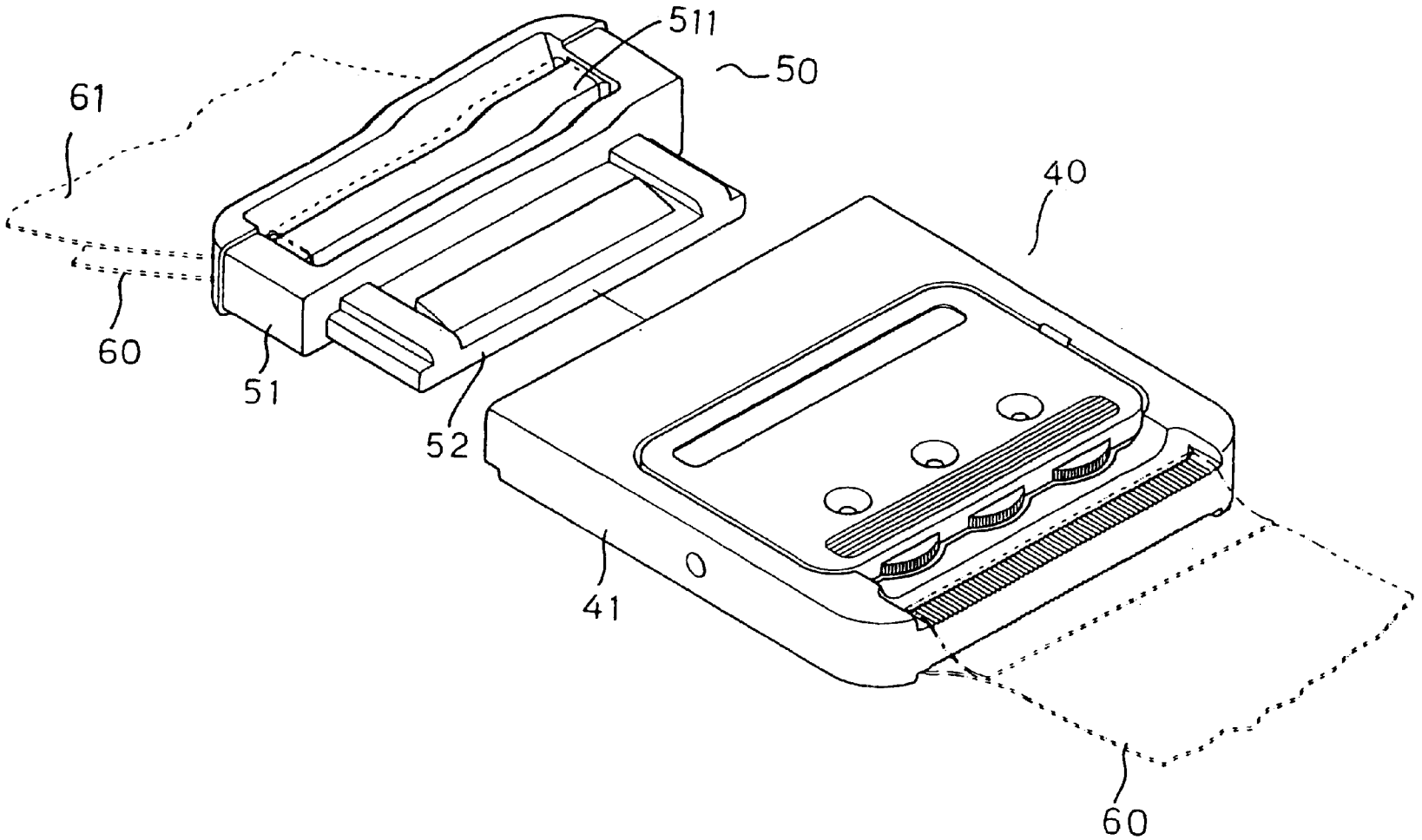
FIG. 9 shows another perspective view of the present invention.
Figure 10:
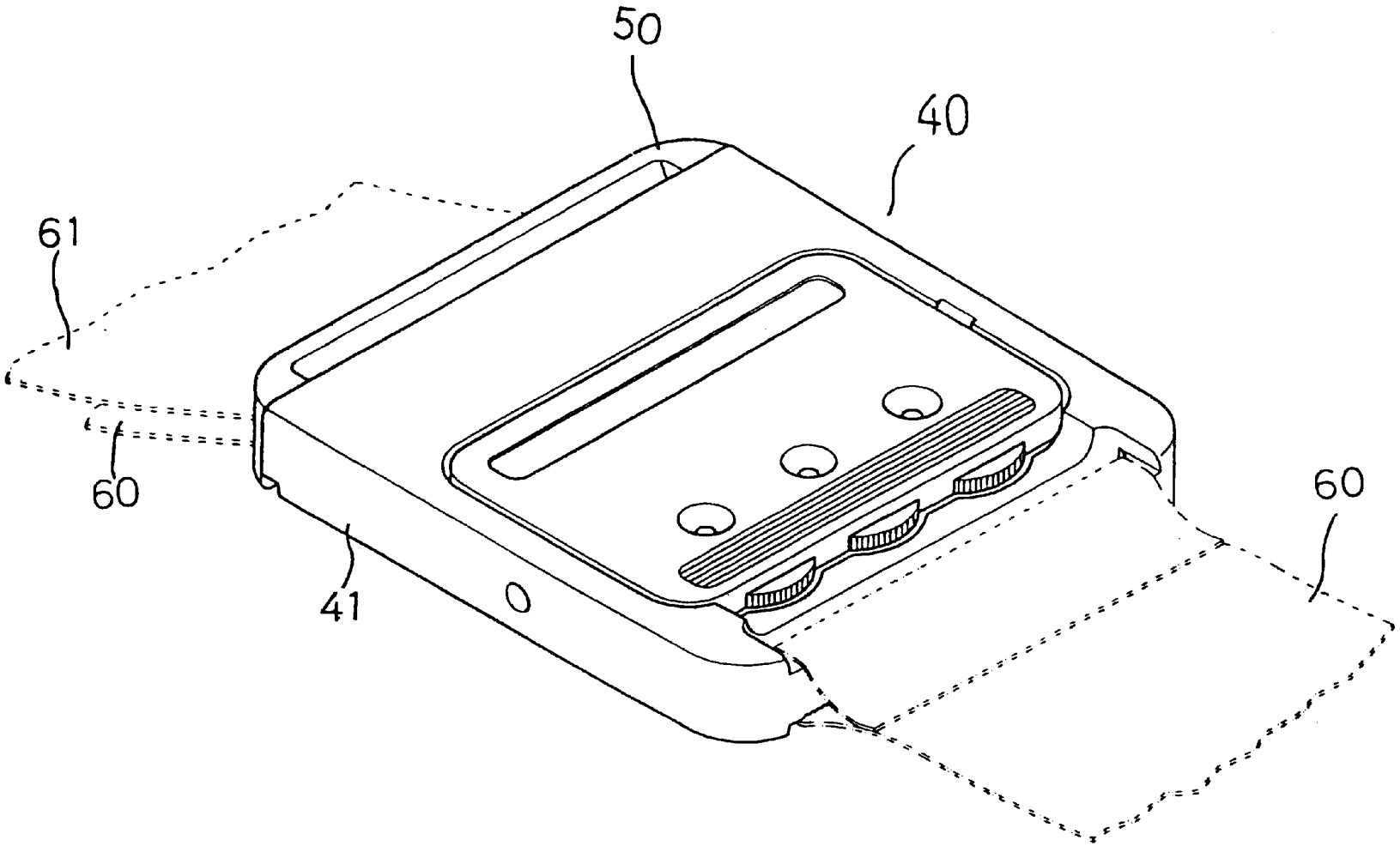
FIG. 10 shows a schematic view of the male retainer engaging the female retainer of the present invention.
Figure 11:
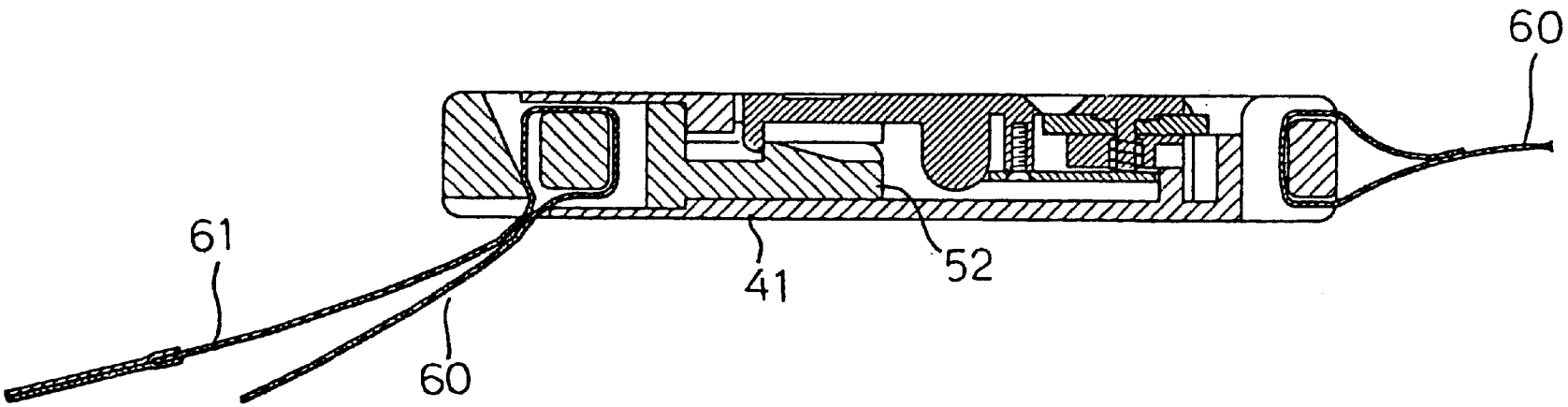
FIG. 11 shows a sectional view of the present invention as shown in FIG. 10.

As shown in FIGS. 9–11, another embodiment of the present invention is composed of a female retainer 40 which is provided with a base 41. The base 41 is so lengthened in relation to the male retainer 50 such that the base 41 is provided with a relatively longer insertion port 411. The male retainer 50 is provided with a frame 51 having an adjustment rod 511, and a retaining tongue 52. When the male retainer 50 is engaged with the female retainer 40, the adjustment rod 511 of the male retainer 50 is covered by the base 41 of the female retainer 40. As a result, the adjustment end 61 of the strap 60 is concealed such that the adjustment rod 511 of the frame 51 of the male retainer 50 is prevented from being tampered with by an unauthorized person.

The embodiments of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claim.

I claim:

1. A retaining apparatus for fastening ends of a strap together comprising:

a male retainer having a retaining tongue and a frame with an adjustment rod extending thereacross, said adjustment rod adapted to receive one end of the strap therein, said retaining tongue having a retaining edge formed thereon;

a female retainer comprising a base and a retaining piece, said base having an insertion port adapted to receive said retaining tongue of said male retainer, said base having a receiving space formed therein, said base having an arresting piece affixed in said receiving space adjacent to said insertion port, said retaining piece having a retaining edge formed thereon, said retaining edge of said retaining piece adapted to selectively engage with said retaining edge of said retaining tongue of said male retainer, said base having a cord fastening rod extending thereacross, said cord fastening rod adapted to receive another end of the strap therein, said base of said female retainer covering said adjustment rod of said male retainer when said retaining edge of said retaining piece engages with the said retaining edge of said retaining tongue; and a lock pivotally connected at a pivoting point connected to said retaining piece of said female retainer, said lock and said retaining piece being received within said receiving space, said lock resiliently connected to said retaining piece by a spring such that said retaining piece moves simultaneous with said lock, said retaining edge of said retaining piece displaceable upwardly upon a downward pressing action on said lock so as to release said retaining edge of said retaining tongue from said retaining edge of said retaining piece, said lock displaceable upwardly from said receiving space upon a downward movement of said retaining piece.

* * * * *